United States Patent [19]

Damour

[11] Patent Number: 4,944,468

[45] Date of Patent: Jul. 31, 1990

[54] EXPANDABLE ROLL SPINDLES WITH INTEGRAL DIRECTIONAL CONTROL VALVE

[76] Inventor: Lawrence R. Damour, 16 Chesler Square, Succasunna, N.J. 07876

[21] Appl. No.: 351,390

[22] Filed: May 10, 1989

[51] Int. Cl.[5] ..... B65H 75/24

[52] U.S. Cl. ..... 242/72 B

[58] Field of Search ..... 242/72 B, 72 R, 68.2; 279/2 A, 1 Q; 269/48.1

[56] References Cited

U.S. PATENT DOCUMENTS 3,834,257 9/1974 Ganser ..... 272/1 Q 3,972,488 8/1976 Lee et al. ..... 242/72 B

*Primary Examiner*—John M. Jillons

*Assistant Examiner*—Yolanda Beth Harris

*Attorney, Agent, or Firm*—Patrick J. Pinto

[57] ABSTRACT

An improved rotatable and expandable spindle assembly, which is adapted for cantilever mounting in and on a machine base. The spindle assembly has an integrally mounted multi-ported directional control valve for point of use operation. The valve is connected to a constant supply of a pressurized medium and is mounted at and on the free end of the spindle assembly. The spindle and valve arrangement is adapted for a rapid expansion or collapsing of the spindle when and as desired by an operator.

9 Claims, 1 Drawing Sheet

EXPANDABLE ROLL SPINDLES WITH INTEGRAL DIRECTIONAL CONTROL VALVE

BACKGROUND OF THE INVENTION

1. Field of the Invention

With respect to the classification of art as established in and by the United States Patent and Trademark Office, this invention is believed to be found in the general class entitled as "Winding and Reeling" and more particularly to "Expandable with Inflatible means".

2. Description of the Prior Art Expanding mandrels and spindles have come into prominence in the material handling field over the last twenty-five to thirty years. Typically these roll spindles are inserted into the cores of roll stock and expanded to grip the inner surface of the roll. Expansion of the spindle may be done by mechanical means or pneumatically.

In pneumatically operated spindles, air is introduced through a check valve or tire valve arrangement. Usually an operator positions a roll of material on a spindle. Subsequently the operator applies air pressure to the spindle by way of a shop-air hose. The shop-air hose is generally adapted to mate with the check valve mounted on the spindle. After the spindle is inflated the hose is disconnected from the spindle. This method of inflation is the subject of many U.S. Patents. U.S. Patents which disclose check valve arrangements are U.S. Pat. No., 2,707,082 issued to Collard Sr. et al, on Apr. 26, 1955; U.S. Pat. No. 3,552,672 issued to Grettve on Jan. 5, 1971; U.S. Pat. No. 3,863,857 issued to Smith on Feb. 4, 1975; U.S. Pat. No. 3,972,488 issued to Lee et al on Aug. 3, 1976; U.S. Pat. 4,101,085 issued to Arno on July 18, 1978; U.S. Pat. No. 4,436,252 issued to Burkle et al on Mar. 13, 1984 and U.S. Pat. No. 4,229,014 issued to Crowe on Oct. 21, 1980. U.S. Pat. No. 4,339,022 issued to Hoover on July 13, 1982 discloses a check valve mounted at one end of a stationary spindle and a hand bellows, for expansion of the spindle, located at the opposite end The Hoover Patent also discloses various combinations of two way valves to expand or collapse the spindle.

Currently available prior art equipment usually provide an arrangement to eliminate the use of a shop-air hose. In this arrangement a central control panel is provided. Directional control valves are mounted in and on the control panel. Each of the valves is connected in series between a common regulated air supply and an expanding spindle. As many as six spindles may be connected in spaced relationship with the control panel. The distance from each spindle to its control valve may be in the range of 2 meters to 4 meters. In this type of arrangement, an operator must position a roll of material on each spindle in an approximate position, then walk over to the control panel to actuate the valve. Should the position of the roll of material be incorrect and need adjusting, the operator must return to the panel to first vent the pressure in the spindle then move the roll of material to a new location. This procedure must be repeated until a correct position for each roll of material is found. Inflation of the spindle is not as rapid as in the shop-air system, due to the its distance from the control panel. Deflation or venting is also delayed due to the length of the conduit between the spindle and the control valve.

In the prior art Patents the operator must search for a supply of air to inflate the expandable spindle after positioning a roll of material thereon. Should the roll of material need to be repositioned on the spindle, the operator must deflate the expanded spindle by allowing the air to escape from the check valve. It is quite possible that shop-air hoses may introduce contaminants, such as dirt, water, etc, into the spindle. These contaminants may cause the check valve to leak or clog passages within the spindle.

It can be seen that a need exists to improve the actuating system for the expansion and venting of spindles An improved actuation system would reduce the unproductive or down time associated with the changing or adjusting of a roll of material.

SUMMARY OF THE INVENTION

This invention may be summarized, at least in part, with respect to its objects. It is an object of this invention to provide and it does provide, an improved expandable spindle having an operator controlled directional control valve mounted on the spindle. This one valve controls both the expansion and venting of the spindle.

It is another object of this invention to provide and it does provide an expandable spindle which maintains a continuous connection with the main air supply, when expansion of the spindle is desired and required.

It is still another object of this invention to provide and it does provide an expandable spindle which has an integrally mounted directional control valve. This valve also providing for the rapid inflation and venting of the spindle when desired.

This present invention provides an improved expandable spindle which has an integrally mounted directional control valve which is actuated by an operator at the point of need without the introduction of an inflating medium from an external source.

In addition to .he above summary, the following disclosure is detailed to insure adequacy and aid in understanding of the invention. This disclosure, however , is not intended to cover each new inventive concept no matter how it may later be disguised by variations in form or additions by further improvements For this reason, there has been chosen specific embodiments of an Expandable Spindle with an integral directional control valve. These specific embodiments have been chosen for the purpose of illustration and description as shown in the accompanying drawings wherein:

BRIEF DESCRIPTION OF THE DRAWINGS

In the following description and in the claims, various details are identified by specific names for convenience. These names are intended to be generic in their application. Corresponding reference characters refer to like members throughout the several figures of the drawings.

Figure 1:
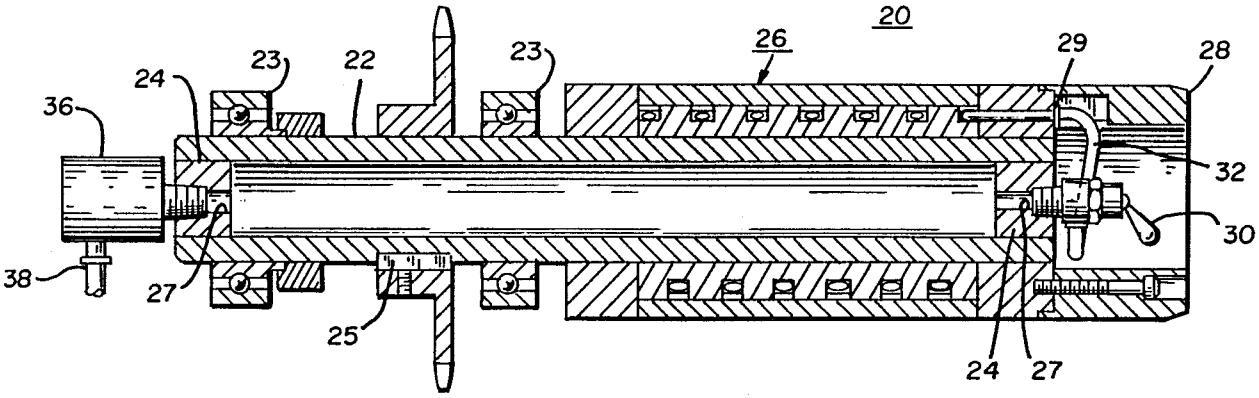
FIG. 1 represents a side elevation view, partially in section, this view showing one embodiment of the present invention.
Figure 2:
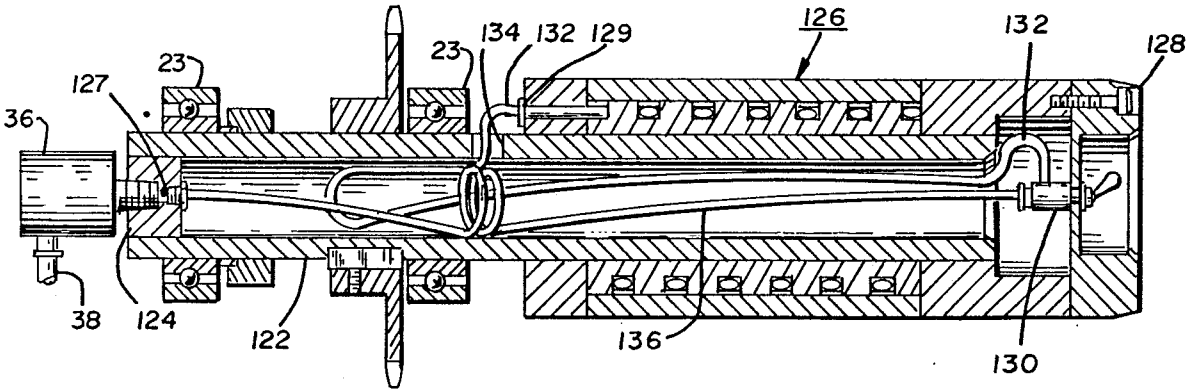
FIG. 2 represents a side elevation view, in section, of the present invention, this view showing an alternate embodiment.

The drawings accompanying, and forming a part, of this specification disclose certain details of construction for an expandable spindle These details are for the purpose of explanation, but structural details may be modified without departure from the concept and the principles of the invention. It is anticipated that this invention may be incorporated in structural forms other than as shown.

DETAILED DESCRIPTION OF FIG. 1

An elongated hollow shaft 22 is rotatably mounted and cantilevered in a pair of bearings 23. Shaft 22 is located and locked in place by conventional means, such as a clamp collar and the like. The shaft 22 is conventionally driven by means of gears, sprocket and chain and the like which may be keyed to the shaft 22 by means of keyseat 25. A pair of like end plugs 24 are fixed into each end of the shaft 22 by means of welding, soldering and the like to provide an air-tight connection. Each of the end plugs 24 has a Threaded aperture 27. The threaded portion of the apertures 27 is preferably a ⅛ National Pipe Thread, but other conventional threading systems may be used. An expanding sleeve portion, generally identified as 26, is secured to the shaft 22 by conventional means such as setscrew and keys, collars and the like. The expanding sleeve portion 26 is provided with a threaded aperture 29 exiting one end of the sleeve 26 distal from the bearing end of the spindle assembly. A valve 30, preferably multi-ported such as a three-way, is connected by means of its inlet or pressure port to the threaded aperture 27 of end plug 24 mounted in the end of the shaft 22, distal the bearing mounted end. A conduit 32 is provided connecting the outlet port of the valve 30 with the threaded aperture 29 of the expanding sleeve member 26. A rotary union 36 is connected to the threaded aperture 27 in plug 24 mounted in the left or bearing end of shaft 22. This rotary union is connected by means of a suitable conduit 38, to a central regulated pressure supply, not shown. A hollow nose portion 28 is fastened in concentric alignment with the expanding sleeve 26 by conventional means. This nose 28 is used to guide the roll of material onto the expanding sleeve 26. The nose 28 also acts to protect the valve 30 from being accidentally damaged by passing material handling equipment. It may be necessary to relieve portions of the interior of the nose to clear the conduit connection to the expanding sleeve member 26.

USE AND OPERATION

A constant supply of a pressurized medium, such as air, is conducted from a central supply through a suitable conduit which is connected to a rotary union 36. The pressurized medium, regulated between 40 to 120 PSI, fills the Hollow shaft assembly comprising the hollow shaft 22 and end plugs 24. The rotary union 36 is provided to allow the continuous rotation of the shaft absent the reeling-in of the supply conduit. After a machine operator positions a roll of material on the spindle assembly 20 at or near a desired location, the operator actuates the valve 30. This actuation allows the passage of a pressurized medium contained within the the hollow shaft assembly to flow into the expanding sleeve portion 26. The expansion of the sleeve is rapid due to its close proximity to the pressurized medium contained within the hollow shaft assembly. In the event that the roll of material must be repositioned on the spindle assembly, the operator deactivates the valve 30. The expanding sleeve is rapidly vented through the valve due to the short length of the conduit 32. After the roll is repositioned, the operator actuates the valve 30 to expand the sleeve 26.

ALTERNATE EMBODIMENT OF FIG. 2

A spindle assembly 120 comprising an elongated hollow shaft 122 which is rotatably mounted to a machine base by a pair of bearing members 23. This shaft 122 is axially aligned with the bearings 23 by conventional means such as a clamp collar. The hollow shaft 122 has one open end and one closed end. The closed end is formed by the insertion of a plug member 124. This end plug 124 is secured in place by conventional means such as a press-fit, setscrew, pinning, welding or the like. A threaded aperture 127 is provided in and through the end plug 124 forming a bulk-head arrangement. This aperture 127 may have either like-threaded or unlike-threaded portions at each of its ends. The selection of threading systems and size of the threads is purely a matter of choice. An aperture 134 is provide in and through the wall of the shaft. The aperture 134 is positioned in the range of 15–20 mm. from an interior or left end of the expanding sleeve 126. The expanding sleeve 126 is secured to the hollow shaft 122 by conventional means such as setscrew and keys, pins, collars and the like. A threaded aperture 129 is provided in and on the interior or left end of the expanding sleeve 126. This aperture 129 allows the pressurized medium to enter or leave the expanding sleeve 126. A nose member 128 is adapted to mount to the expanding sleeve 126 at and on its outer or right end. Nose member is adapted for panel-mounting of a suitable multi-port valve 130, such as a three-way valve.

A first conduit 136 connects the interior threaded aperture of the end plug 124 with the inlet port of the valve 130. The connection of the conduit is made by conventional fittings. A second conduit 132 connects the outlet port of the valve 130 with the threaded aperture 129 of the expanding sleeve 126. The second conduit 132 is shown as passing interior of the shaft 122, then through aperture 134 before connecting with aperture 129, but other arrangements may be selected for use. The nose member 128 also acts to protect the valve 130 from accidental damage by passing material handling equipment. A rotary union 36 is connected to the exterior threaded portion of aperture 127. This rotary union 36 is connected by an elongated conduit 38 to a central supply of a regulated pressurized fluid, preferably air but a hydraulic fluid may be used.

USE AND OPERATION

The operation of the spindle assembly 120 is similar to the embodiment of FIG. 1. A constant supply of a pressurized medium, such as compressed air selectively pressure regulated between 40 to 120 PSI, is conducted from a central supply through a suitable conduit 38. This conduit 38 is connected to the supply port of a rotary union 36. The pressurized medium is conducted from the rotary union 36 through the end plug 124 and flexible conduit 136 to the inlet port of the directional control valve 130. When it is desired to inflate the expanding sleeve 126, the operator energizes the valve by means of the actuator provided, a toggle switch arrangement is shown but other suitable means may be used. When the valve 130 is energized, the pressurized medium rapidly fills the expanding sleeve 126 by way of flexible conduit 132, connected to a outlet port of the valve. When it is desireable to deflate the expanding sleeve 126, the operator will de-energize the valve 130. The pressurized medium rapidly passes from the expanding sleeve 126 through conduit 132 and out a third or exhaust port of the valve 130. Nose 128 provides a similar function as nose member 28 in FIG. 1. Conduit members 132, and 136 are shown having service loops which allow for easy installation and removal of nose 128 from the spindle assembly 120.

EMBODIMENT OF FIG. 3

Figure 3:
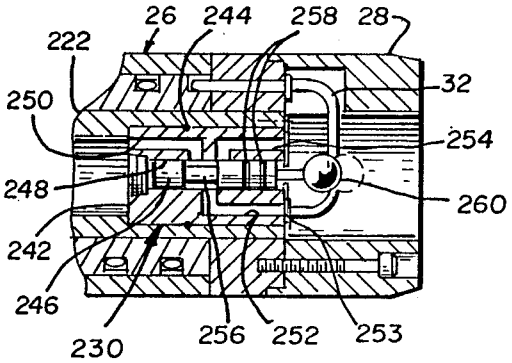
FIG. 3 represents a fragmentary sectional view of a cantilevered end of the spindle, and showing an alternate valve means.

Referring to FIG. 3, a fragmentary portion of an elongated hollow shaft member 222 which is rotatably mounted and cantilevered in and by a pair of bearings 23. The construction of the left end of the hollow shaft 222, not shown, is similar to shaft 22 as seen in FIG. 1. Hollow shaft 222 has one closed or left end. A rotary union 36 is threaded into an aperture 27. The right end of the hollow shaft 222 is bored to a selected diameter and depth to accept valve assembly 230. This valve 230 includes a cylindrical body 242 having an annular groove to accept an o-ring 244 for sealing the outer diameter of the valve body 242 with the bored hole of the shaft. A valve spool 246 is slidably carried in a central through bore 248. A first or pressure passageway 250 is provided in the valve body 242, for connecting the pressurized interior of the hollow shaft 222 with the interior bore 248 of the valve 230. A second passageway 252 is provided in the valve body 242 for connecting the bored hole 248 of the valve with a threaded port 253. Port 253 is adapted to accept conduit 32, which has been shown and described in FIG. 1. A third or exhaust passageway 254 is provided in the valve 230 to connect the bore 248 in the valve body 242 with atmosphere. The spool 246 has an elongated undercut portion 256 which directs the flow of air through the valve as the spool is moved from left to right. A pair of annular shallow grooves 258 are provided to engage a conventional detent means, not shown, mounted in the valve body 242, such as a ball detent, to hold the spool 246 in a desired position. A handle member 260 is provided exterior the valve 230 to act as an actuator. An operator would selectively slide the valve to the right or left to attain the desired results. The valve 230 is removably retained in the hollow shaft 222 by a suitable means such as machine screws or retaining rings. The left and right extent of spool movement is limited by suitable stop means.

USE AND OPERATION

Referring to FIG. 3, an operator would move the handle 260 inward or to the left to expand the sleeve 26. With the spool moved to the left a pressurized medium passes from the interior of the hollow shaft 222 into the expanding sleeve 26 by the communication of the first passageway 250 with second passageway 252. If the operator desires to exhaust the expanding sleeve 26, he or she would pull the handle to the right. The pressurized medium will be exhausted from the sleeve 26 by the communication of the second passageway 252 with the exhaust port 254.

In the embodiments of FIG. 1; 2; and 3 inflation and deflation of the expanding spindle is rapid due to its close proximity of a constant supply of a pressurized medium. Actuation of the directional control valve takes place at the point of use, namely at the spindle assembly. The introduction of contaminants are eliminated due to provision of a more or less closed system. During the period of spindle expansion and rotation, a constant supply of regulated pressurized medium is supplied until no longer needed.

Conduits 32, 132, and 136 may be made of conventional thermoplastic tubing in combination with suitable fittings, but other types of conduit may be used to satisfy a design requirement.

In its construction and use, the expandable roll spindle depicted and described above is believed to provide the basis of a method of construction and use. This method includes the steps of:

providing an elongated hollow shaft having an inner diameter and an outer diameter, said shaft having a first end portion and a second distal end portion;

adapting said hollow shaft for cantilever mounting by said first end;

retentively engaging an expanding sleeve member on the outer diameter of the second end of he shaft, said spindle adapted to loosely receive a roll of material thereon;

providing a directional control valve, said valve having at least one inlet port, at least one outlet port, at least one exhaust port, and an actuating means for operating said valve;

connecting a first elongated conduit to said inlet port of the valve, said first conduit carrying a pressurized medium to said pressurized port, said first conduit allowing for the continuous rotation of the spindle;

mounting said valve to the spindle assembly at or near the second end of the shaft, for allowing the passage of said pressurized medium interior of the hollow shaft;

connecting a second elongated conduit from said outlet port to the expanding sleeve member;

selectively operating said actuator, for the rapid expansion or exhausting of said sleeve member, said expansion of said sleeve for retentively engaging an interior diameter of the roll of material.

Terms such as "left", "right", "up", "down", "bottom", "top", "front", "back", "in", "out" and the like are applicable to the embodiment shown and described in conjunction with the attached drawings. These terms are merely for the purpose of description and do not necessarily apply to the position in which the rotary expanding spindle assembly of the present invention may be constructed or used.

While this particular embodiment of a rotary expanding spindle assembly has been shown and described, it is understood that the invention is not limited thereto and protection is sought to the broadest extent that the prior art allows.

What is claimed is:

1. An improved rotatable and expandable spindle assembly comprising:

(a) an elongated hollow shaft having an inner diameter and an outer diameter;

(b) a first end portion of said hollow shaft;

(c) a second end portion of said hollow shaft, said second end distal said first end;

(d) said hollow shaft adapted for cantilever mounting by said first end;

(e) an elongated expanding sleeve member, said sleeve member retentively engaged on the outer diameter of the second end of the shaft, said sleeve member adapted to loosely receive a roll of material thereon;

(f) a three way directional control valve having at least one inlet port, at least one outlet port, and at least one exhaust port;

(g) an actuating means for operating said valve;

(h) a first elongated conduit connected to said inlet port of the valve, said first conduit for carrying a constant supply of a pressurized medium into said inlet port, said first conduit including means for allowing the selective continuous rotation of the spindle;

(i) a means for mounting said valve to the spindle assembly at or near the second end of the shaft, said mounting means allowing for the passage of the constant supply of the pressurized medium interior of said hollow shaft;

(j) a second elongated conduit means for connecting said outlet port of the valve with the expanding sleeve member; and (k) said actuator means adapted for selectively operating said valve for directionally controlling the flow of the pressurized medium either to or away from the expandable sleeve member, for a rapid expansion or exhausting of said sleeve member, said expansion of said sleeve member to retentively engage an interior diameter of the roll of material placed thereon with a constant supply of the pressurized medium.

2. An improved expandable spindle as in claim 1, wherein said means for allowing includes a rotary union mounted at or near the first end of the shaft, said inlet port during continuous rotation of the spindle assembly.

3. An improved expandable spindle assembly as in claim 2 wherein said first conduit includes;

(a) a first closed end of said hollow shaft, said first closed end adapted for the air-tight passage of the constant supply of said pressurized medium from the rotary union into the hollow shaft;

(b) a second closing means for enclosing the distal end of the hollow shaft, said second closing means adapted for the air-tight passage of the pressurized medium into the inlet port of the valve.

4. An improved expanding mandrel assembly as in claim 3 wherein said second closing means is also the directional control valve, said valve adapted for removable insertion into the inside diameter of the hollow shaft.

5. An improved expandable spindle assembly as in claim 3 including a hollow nose member carried on the distal end of said spindle assembly, said nose member adapted for recess mounting of the valve member, said nose member also providing protection for the valve from accidental damage by passing equipment.

6. A method for making and using an improved rotatable and expandable spindle assembly including the following steps:

(a) providing an elongated hollow shaft having an inner diameter and an outer diameter, said elongated shaft having a first end portion and a distal second end;

(b) cantileverly mounting said hollow shaft by said first end;

(c) retentively engaging an expanding sleeve member on the outer diameter of the second end of the shaft, said sleeve member adapted to loosely receive a roll of material thereon;

(d) providing a three-way directional control valve having at least one inlet port, at least one outlet port, at least one exhaust port and an actuating means for operating said valve;

(e) connecting a first elongated conduit to said inlet port of the valve, said first conduit carrying a constant supply of a pressurized medium into said inlet port while allowing for the continuous rotation of the spindle;

(f) mounting said valve to the spindle assembly at or near the second end of the shaft, said mounting allowing for the passage of said constant supply of said pressurized medium interior of the hollow shaft;

(g) connecting a second elongated conduit from said second port of the valve to the expanding sleeve member;

(h) selectively operating the actuator means of the valve for either a rapid expansion or exhausting of said sleeve member, said expansion of said sleeve for the retentive engagement of an interior diameter of the roll of material placed thereon with said constant supply of said pressurized medium.

7. A method as in claim 6 including the additional step of mounting a rotary union intermediate the first conduit at or near the first end of the shaft, said rotary union adapted for carrying said pressurized medium to said inlet port.

8. A method as in claim 7 including the following step of:

(a) enclosing the first end of the hollow shaft for the air-tight passage of the constant supply of said pressurized medium from the rotary union into the inner diameter of the shaft;

(b) enclosing the second end of the shaft for the air-tight passage of the constant supply of said pressurized medium into the valve.

9. A method as in claim 8 wherein the step of enclosing the second end of the hollow shaft further includes removably inserting the control valve into the inner diameter of the hollow shaft and providing an air-tight connection between the valve and the inner diameter.

* * * * *

UNITED STATES PATENT AND TRADEMARK OFFICE

CERTIFICATE OF CORRECTION

ATENT NO. : 4,944,468

ATED : July 31, 1990

VVENTOR(S) : Lawrence R. Damour

It is certified that error appears in the above-identified patent and that said Letters Patent is hereby orrected as shown below:

Claim 2 should read as follows:

2. An improved expandable spindle as recited in claim 1, ıerein said means for allowing includes a rotary union ›unted at or near the first end of the shaft, said rotary ıion for carrying said constant supply of said pressurized ›dium to said inlet port during continuous rotation of the ›indle assembly.

›lumn 1, line 12, "Expanding mandrel----" should begin a ›w paragraph under the heading "2. Description of the Prior Art"

›lumn 1, line 40, a "." should be inserted between "end" and The Hoover".

Signed and Sealed this

Thirteenth Day of November, 1990

*Attest:*

HARRY F. MANBECK, JR.

*Attesting Officer*

*Commissioner of Patents and Trademarks*